US008833763B2

(12) United States Patent
Morikawa et al.

(10) Patent No.: US 8,833,763 B2
(45) Date of Patent: Sep. 16, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Shuichi Morikawa, Kahoku (JP); Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/962,700

(22) Filed: Aug. 8, 2013

(65) Prior Publication Data

US 2014/0054845 A1 Feb. 27, 2014

(30) Foreign Application Priority Data

Aug. 24, 2012 (JP) ..... 2012-185247

(51) Int. Cl.
*B65H 7/12* (2006.01)
*B65H 5/00* (2006.01)

(52) U.S. Cl.
CPC ..... *B65H 5/00* (2013.01)
USPC ..... 271/263; 271/258.01

(58) Field of Classification Search
USPC ..... 271/263, 258.01
See application file for complete search history.

(56) References Cited

U.S. PATENT DOCUMENTS 6,741,727 B1 * 5/2004 Hirasawa ..... 382/112
7,845,637 B2 12/2010 Shimazaki
8,066,280 B2 11/2011 Simonis et al.
8,091,888 B2 1/2012 Tamamoto
8,266,965 B2 9/2012 Schoen
8,419,014 B2 4/2013 Yamagishi et al.
8,567,777 B2 * 10/2013 Syracuse et al. ..... 271/263
2002/0079644 A1 6/2002 Phinney
2005/0127597 A1 6/2005 Sano et al.

(Continued)

FOREIGN PATENT DOCUMENTS

JP 56-159656 12/1981
JP 57-169767 10/1982

(Continued)

OTHER PUBLICATIONS

Office action mailed Jul. 9, 2013 in JP 2012-185165 including English translation, 6pp.

(Continued)

*Primary Examiner* — Kaitlin Joerger
(74) *Attorney, Agent, or Firm* — Christie, Parker & Hale, LLP

(57) ABSTRACT

There are provided a paper conveying apparatus, a jam detection method and a computer-readable, non-transitory medium that can suppress erroneous detection of a jam by sound due to the sound which a paper which has a wrinkle generates. The paper conveying apparatus includes a separator, a sound signal generator, provided with a sound detector provided at a downstream side of the separator, for generating a sound signal in accordance with the sound generated by a paper during conveyance, a sound jam detector for determining whether a jam has occurred based on the sound signal, and a wrinkle detector, provided at a downstream side of the separator, for detecting optically a wrinkle of a paper, wherein the sound jam detector changes the method of detection of the jam when the wrinkle detector detects a wrinkle of a paper.

7 Claims, 14 Drawing Sheets

(56) References Cited

U.S. PATENT DOCUMENTS

| | | | | |
|---|---|---|---|---|
| 2006/0145412 | A1 | 7/2006 | Tagawa et al. | |
| 2008/0224390 | A1 | 9/2008 | Ma et al. | |
| 2011/0278786 | A1* | 11/2011 | Yamagishi et al. | 271/18 |
| 2011/0292459 | A1* | 12/2011 | Murosaki | 358/442 |
| 2012/0019841 | A1* | 1/2012 | Schaertel et al. | 358/1.9 |
| 2012/0235929 | A1* | 9/2012 | Hongo et al. | 345/173 |
| 2013/0093136 | A1 | 4/2013 | Sakharshete et al. | |
| 2013/0140757 | A1 | 6/2013 | Phinney et al. | |
| 2013/0140760 | A1 | 6/2013 | Syracuse et al. | |
| 2013/0300056 | A1 | 11/2013 | Kai | |

FOREIGN PATENT DOCUMENTS

| | | | |
|---|---|---|---|
| JP | 62117364 | A * | 5/1987 |
| JP | 3-192050 | | 8/1991 |
| JP | 04-264462 | | 9/1992 |
| JP | 5-24716 | | 2/1993 |
| JP | 06-103438 | | 4/1994 |
| JP | 2000-182052 | | 6/2000 |
| JP | 2000-251108 | | 9/2000 |
| JP | 2001-302021 | | 10/2001 |
| JP | 2003-212386 | | 7/2003 |
| JP | 2006-84595 | | 3/2006 |
| JP | 2006-298606 | | 11/2006 |
| JP | 2009-161291 | | 7/2009 |
| JP | 2010-166442 | | 7/2010 |
| JP | 2011-31999 | | 2/2011 |
| JP | 2011-37524 | | 2/2011 |
| JP | 2011-244091 | | 12/2011 |
| JP | 2011-254248 | | 12/2011 |
| JP | 2012-131579 | | 7/2012 |

OTHER PUBLICATIONS

Office action mailed Jul. 9, 2013 in JP 2012-185247 including English translation, 6pp.

Office action mailed Sep. 24, 2013 in JP 2012-185247 including English translation, 5pp.

Office action mailed Jul. 9, 2013 in JP 2012-185335 including English translation, 6pp.

Office action mailed Jul. 9, 2013 in JP 2012-185404 including English translation, 5pp.

Office action mailed Jul. 9, 2013 in JP 2012-203446 including English translation, 6pp.

Office action mailed Jan. 7, 2014 in JP 2012-185247 including English translation, 4pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185247, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection apparatus of a copier which converts the sound which is generated on the conveyance path to an electrical signal and determines that a jam has occurred when the time when the signal is over a reference level exceeds a reference value has been disclosed (see Japanese Laid-open Patent Publication No. 57-169767).

Further, a document scanner which acquires an image of a document in an input tray which holds the document and which optimizes the sound jam detection parameter when a wrinkle is detected has been disclosed (see U.S. Patent Publication No. 2012/0019841A).

SUMMARY

When a paper which has a wrinkle is conveyed, a large sound is generated on the conveyance path, so sometimes it is erroneously determined whether a jam has occurred. Such a wrinkle is sometimes caused during conveyance of the paper.

Accordingly, it is an object of the present invention to provide a paper conveying apparatus and a jam detection method that can suppress erroneous detection of an occurrence of a jam by sound due to the sound which a paper which has a wrinkle generates and a computer-readable, non-transitory medium storing a computer program for causing a computer to implement such a jam detection method.

According to an aspect of the apparatus, there is provided a paper conveying apparatus. The paper conveying apparatus includes a separator, a sound signal generator, provided with a sound detector provided at a downstream side of the separator in a paper conveyance direction, for generating a sound signal corresponding to a sound generated by a paper during conveyance of the paper, a sound jam detector for determining whether a jam has occurred based on the sound signal, and a wrinkle detector, provided at a downstream side of the separator in the paper conveyance direction, for optically detecting a wrinkle of the paper, wherein the sound jam detector changes the method of detection of the jam when the wrinkle detector detects the wrinkle of the paper.

According to an aspect of the method, there is provide a jam detection method. The jam detection method includes acquiring a sound signal from a sound signal generator, provided with a sound detector provided at a downstream side of a separator in a paper conveyance direction, for generating the sound signal corresponding to a sound generated by a paper during conveyance of the paper, determining whether a jam has occurred based on the sound signal, and detecting, by a computer, an output of a wrinkle detector, provided at a downstream side of the separator in the paper conveyance direction, for optically detecting a wrinkle of the paper, and changing by the computer the method of detection of the jam when the wrinkle of the paper is detected, in the determining step.

According to an aspect of the computer-readable, non-transitory medium storing a computer program, the computer program causes a computer to execute a process, including acquiring a sound signal from a sound signal generator, provided with a sound detector provided at a downstream side of a separator in a paper conveyance direction, for generating the sound signal corresponding to a sound generated by a paper during conveyance of the paper, determining whether a jam has occurred based on the sound signal, and detecting an output of a wrinkle detector, provided at a downstream side of the separator in the paper conveyance direction, for optically detecting a wrinkle of a paper, and changing by the computer the method of detection of the jam when the wrinkle of the paper is detected, in the determining step.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
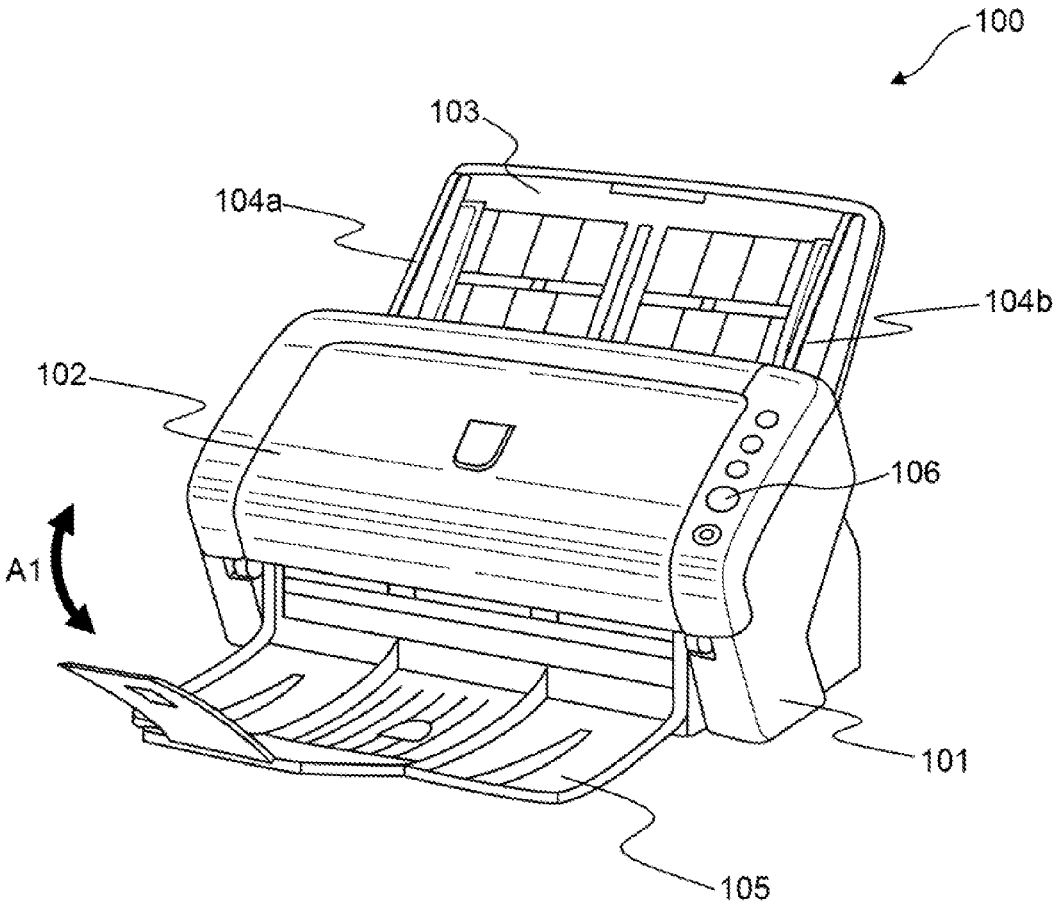
FIG. 1 is a perspective view of a paper conveying apparatus 100 according to an embodiment.

FIG. 1 is an exemplary embodiment of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
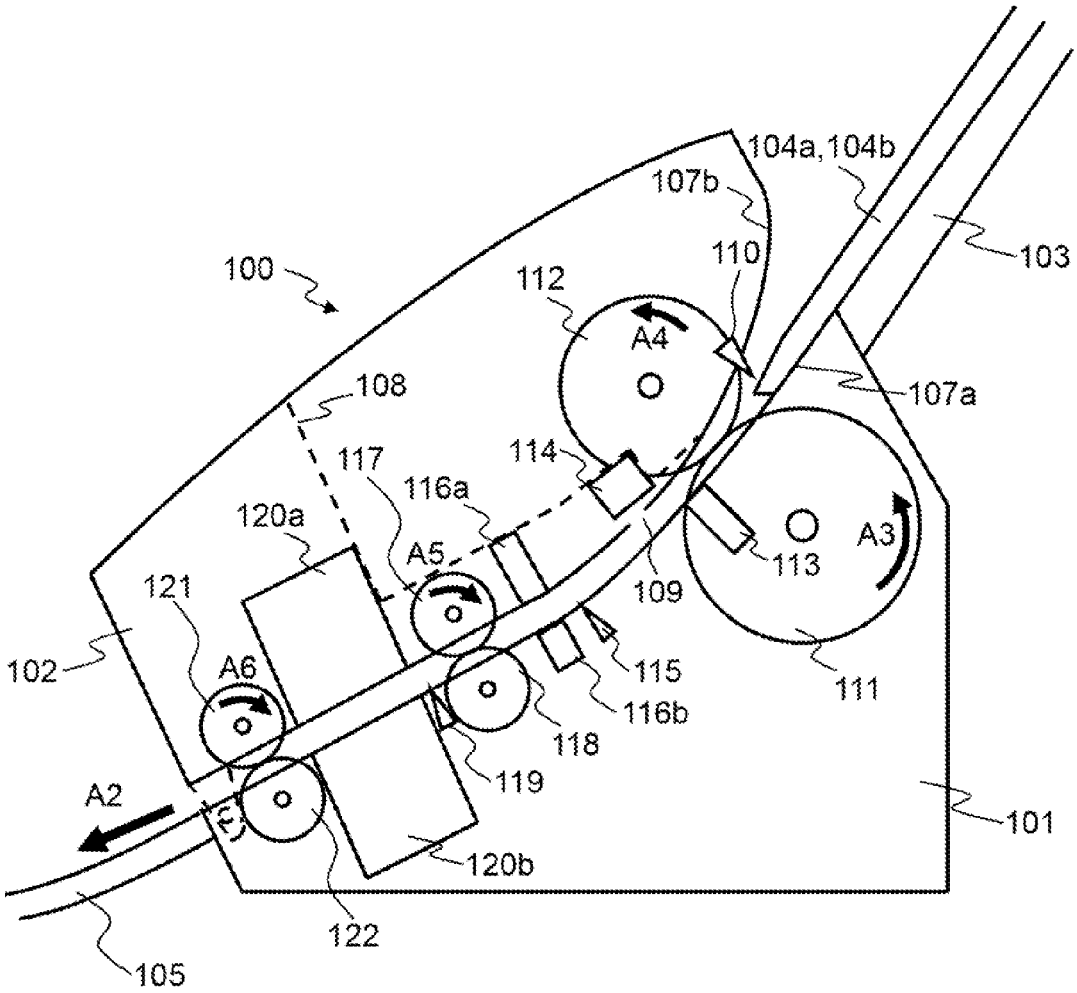
FIG. 2 is a view for explaining an example of the conveyance route at the inside of the paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a wrinkle detector 113, a microphone 114, a second paper detector 115, an ultrasonic transmitter 116*a*, an ultrasonic receiver 116*b*, a first conveyor roller 117, a first driven roller 118, a third paper detector 119, a first image capture unit 120*a*, a second image capture unit 120*b*, a second conveyor roller 121, a second driven roller 122, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 114 is an example of a sound detector, detects the sound generated by a paper during conveyance of the paper, and generates and outputs an analog signal corresponding to the detected sound. The microphone 114 is arranged at the downstream side of the paper feed roller 111 and the retard roller 112 while fastened to the frame 108 at the inside of the upper housing 102. A hole 107 is provided in the upper guide 107*b* facing the microphone 114, so that the sound generated by the paper during conveyance of the paper can be more accurately detected by the microphone 114.

The second paper detector 115 has a contact detection sensor which is arranged at a downstream side of the paper feed roller 111 and the retard roller 112 and at an upstream side of the first conveyor roller 117 and first driven roller 118 and detects if there is a paper present at that position. The second paper detector 115 generates and outputs a second paper detection signal which changes in signal value between a state at which there is a paper at that position and a state where there is no paper there.

The ultrasonic transmitter 116*a* and the ultrasonic receiver 116*b* are arranged near the conveyance path of the paper so as to face each other across the conveyance path. The ultrasonic transmitter 116*a* transmits an ultrasonic wave. On the other hand, the ultrasonic receiver 116*b* detects an ultrasonic wave which is transmitted by the ultrasonic transmitter 116*a* and passes through the paper or papers, and generates and outputs an ultrasonic signal comprised of an electrical signal corresponding to the detected ultrasonic wave. Below, the ultrasonic transmitter 116*a* and the ultrasonic receiver 116*b* will sometimes be referred to altogether as the "ultrasonic sensor 116".

The third paper detector 119 has a contact detection sensor which is arranged at a downstream side of the first conveyor roller 117 and the first driven roller 118 and an upstream side of the first image capture unit 120*a* and the second image capture unit 120*b* and detects if there is a paper at that position. The third paper detector 119 generates and outputs a third paper detection signal which changes in signal value between a state where there is a paper at that position and a state where there is no such paper there.

The first image capture unit 120*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 120*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 120*a* and the second image capture unit 120*b* and read only one surface of the paper. Further, instead of a CIS, it is also possible to utilize an image capturing sensor of a reduced magnification optical system type using CCD's (charge coupled devices). Below, the first image capture unit 120*a* and the second image capture unit 120*b* will sometimes be referred to overall as the "image capture units 120".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 117 and the first driven roller 118 while being guided by the lower guide 107*a* and the upper guide 107*b*. The paper is sent between the first image capture unit 120*a* and the second image capture unit 120*b* by the first conveyor roller 117 rotating in the direction of the arrow mark A5 of FIG. 2. The paper which is read by the image capture unit 120 is ejected onto the ejection tray 105 by the second conveyor roller 121 rotating in the direction of the arrow mark A6 of the FIG. 2.

Figure 3:
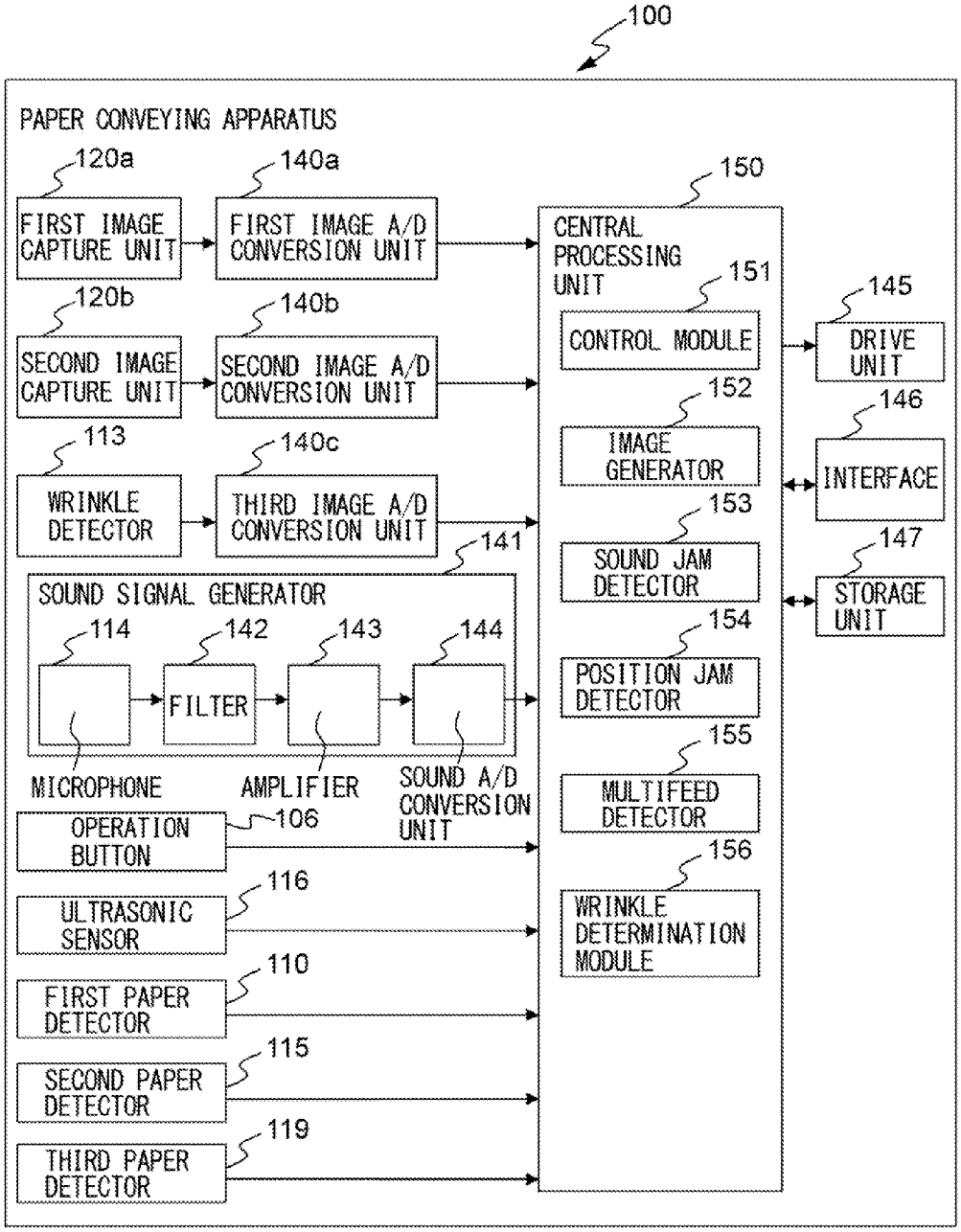
FIG. 3 is an example of a block diagram which shows the general configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, second image A/D conversion unit 140*b*, third image A/D conversion unit 140*c*, sound signal generator 141, drive unit 145, interface 146, storage unit 147, central processing unit 150, etc.

The first image A/D conversion unit 140*a* converts an analog image signal which is output from the first image capture unit 120*a* from an analog to digital format to generate digital image data which it then outputs to the central processing unit 150. Similarly, the second image A/D conversion unit 140*b* converts the analog image signal which is output from the second image capture unit 120*b* from an analog to digital format to generate digital image data which it then outputs to the central processing unit 150. Below, these digital image data will be referred to as the "read image".

The sound signal generator 141 includes a microphone 114, a filter 142, an amplifier 143, a sound A/D conversion unit 144, etc., and generates a sound signal. The filter 142 applies a bandpass filter which passes a predetermined frequency band of a signal to an analog signal which is output from the microphone 114 and outputs it to the amplifier 143. The amplifier 143 amplifies the signal which is output from the filter 142 and outputs it to the sound A/D conversion unit 144. The sound A/D conversion unit 144 converts the analog signal which is output from the amplifier 143 to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 114, while the filter 142, the amplifier 143, and the sound A/D conversion unit 144 may be provided outside of the sound signal generator 141. Further, the sound signal generator 141 may include only the microphone 114 and the filter 142 or only the microphone 114, the filter 142, and the amplifier 143.

The drive unit 145 includes one or more motors and uses control signals from the central processing unit 150 to rotate the paper feed roller 111, the retard roller 112, the first conveyor roller 117, and the second conveyor roller 121 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, wrinkle detector 113, microphone 114, second paper detector 115, ultrasonic sensor 116, third paper detector 119, first image capture unit 120*a*, second image capture unit 120*b*, first image A/D conversion unit 140*a*, second image A/D conversion unit 140*b*, third image A/D conversion unit 140*c*, sound signal generator 141, drive unit 145, interface 146, and storage unit 147 and controls these units.

The central processing unit 150 control a drive operation of the drive unit 145, control a paper read operation of the image capture unit 120, etc., to acquire a read image. Further, the central processing unit 150 has a control module 151, an image generator 152, a sound jam detector 153, a position jam detector 154, a multifeed detector 155, a wrinkle determination module 156, etc. These units are functional modules which are realized by software which operate on a processor. Note that, these units may be comprised of respectively independent integrated circuits, a microprocessor, firmware, etc.

Figure 4:
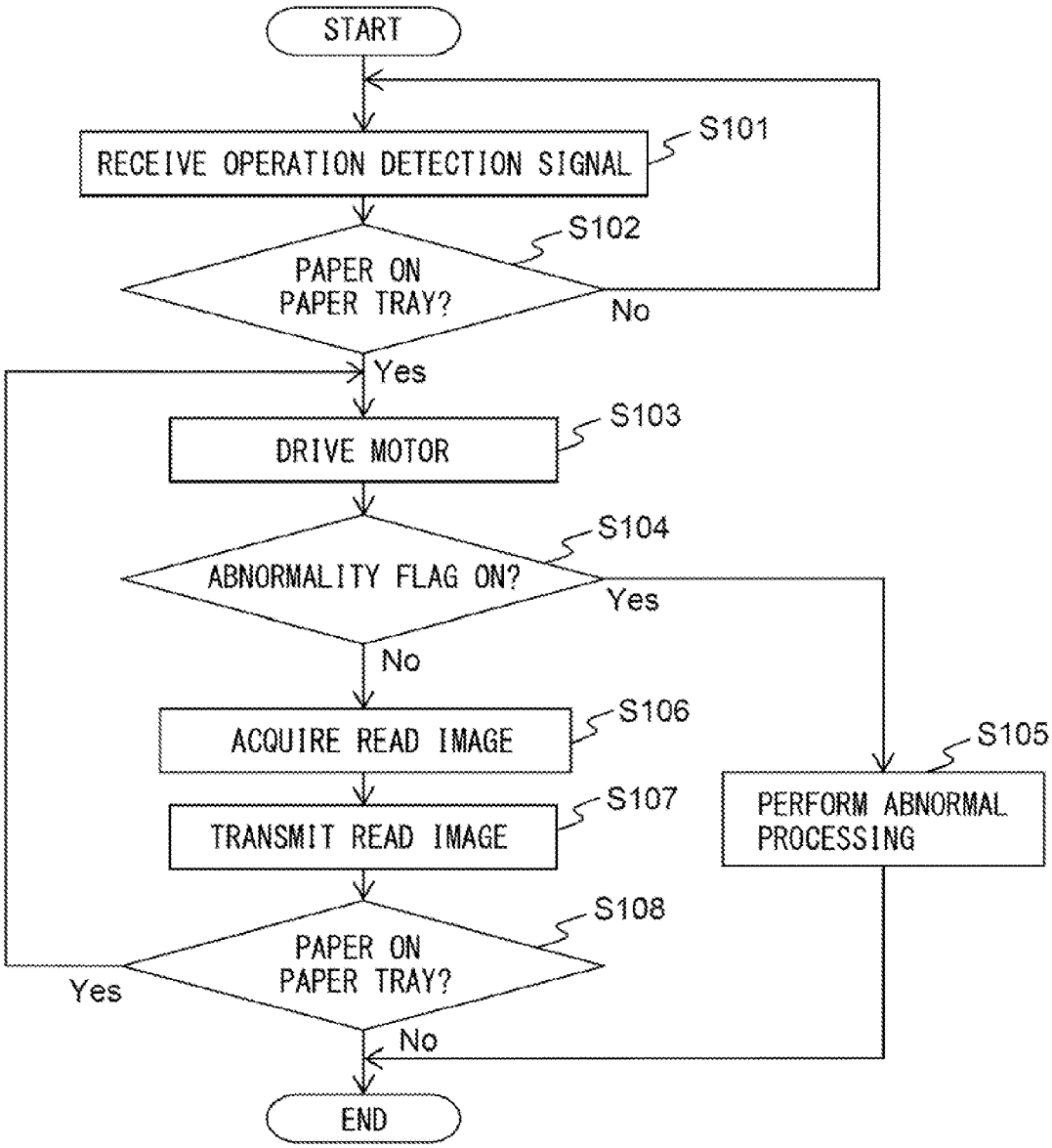
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 117, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 120*a* and the second image capture unit 120*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determines whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
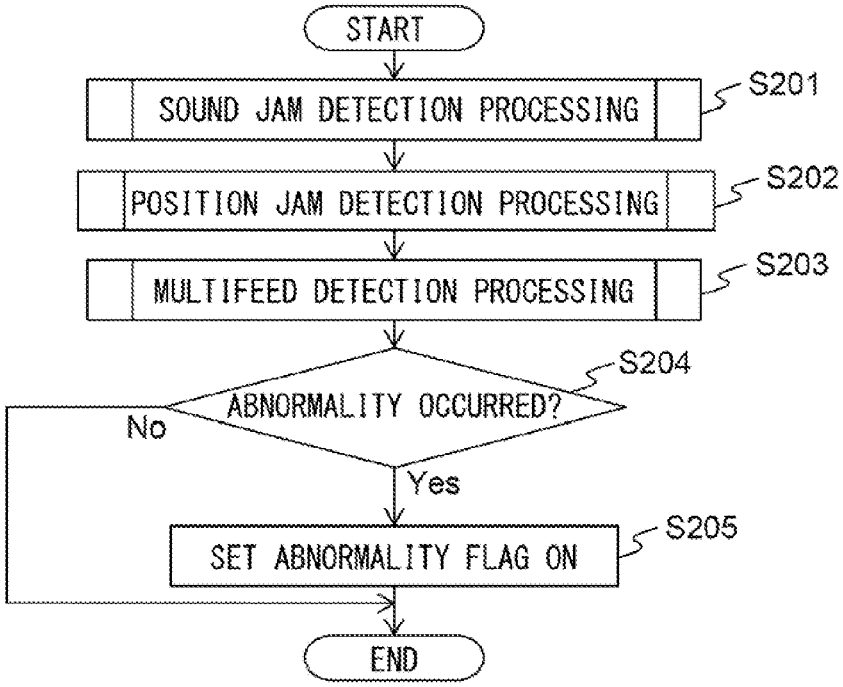
FIG. 5 is a flow chart which shows an example of an abnormality detection of the paper conveyance.

FIG. 5 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 115 and the third paper detection signal which is acquired from the third paper detector 119. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
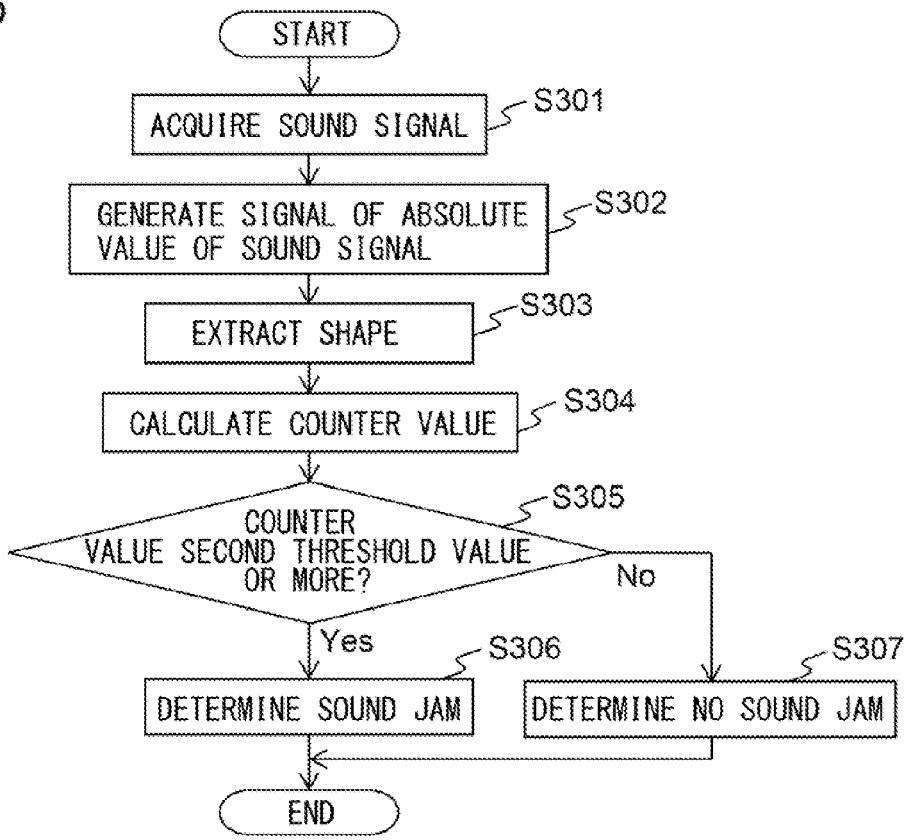
FIG. 6 is a flow chart which shows an example of operation of a sound jam detection processing.

FIG. 6 is a flow chart which shows an example of operation of a sound jam detection processing.

The flow of operation which is shown in FIG. 6 is executed at step S201 of the flow chart which is shown in FIG. 5.

First, the sound jam detector 153 acquires a sound signal from the sound signal generator 141 (step S301).

Figure 7A:
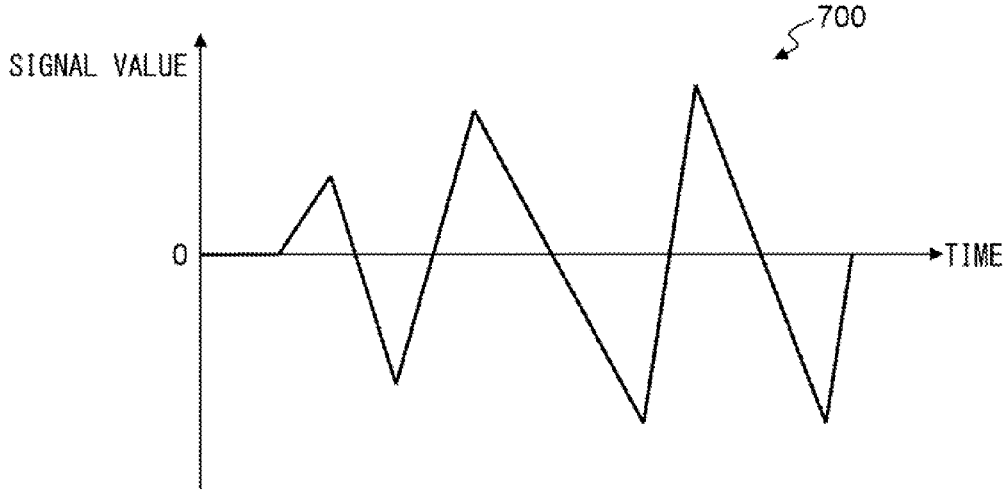
FIG. 7A is a view for explaining processing for detection of an occurrence of a jam.

FIG. 7A is a graph which shows an example of a sound signal. The graph 700 which is shown in FIG. 7A shows a sound signal which is acquired from the sound signal generator 141. The abscissa of graph 700 shows the time, while the ordinate shows the signal value of the sound signal.

Next, the sound jam detector 153 generates a signal of the absolute value of the sound signal received from the sound signal generator 141 (step S302).

Figure 7B:
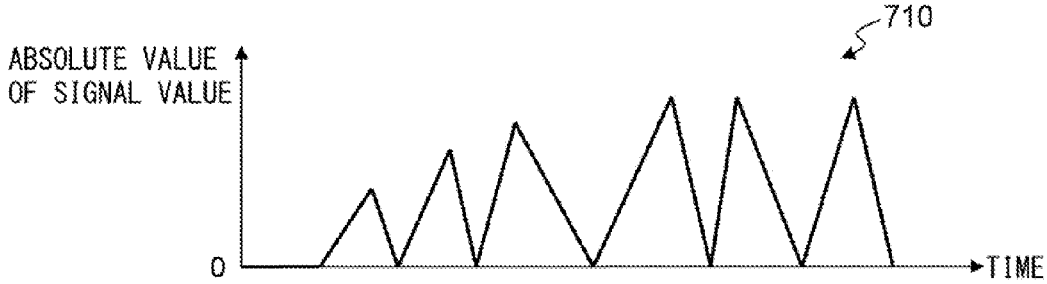
FIG. 7B is a view for explaining processing for detection of an occurrence of a jam.

FIG. 7B is a graph which shows an example of the signal of the absolute value of the sound signal. The graph 710 which is shown in FIG. 7B shows the signal of the absolute value of the sound signal of the graph 700. The abscissa of graph 710 shows the time, while the ordinate shows the signal of the absolute value of the sound signal.

Next, the sound jam detector 153 extracts a shape of a signal of the absolute value of the sound signal (step S303). The sound jam detector 153 extracts the envelope as the shape of the signal of the absolute value of the sound signal.

Figure 7C:
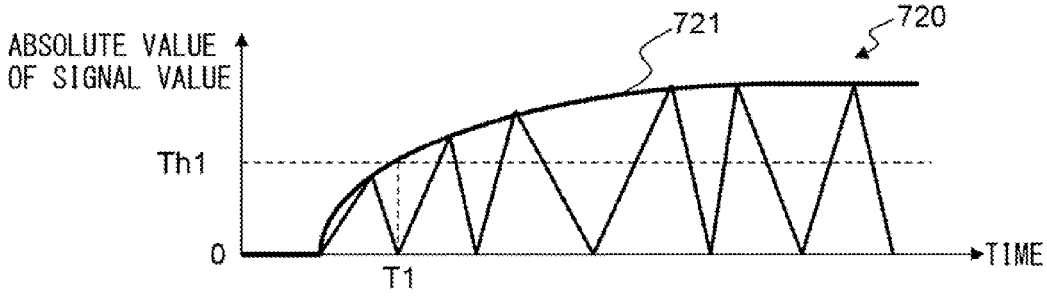
FIG. 7C is a view for explaining processing for detection of an occurrence of a jam.

FIG. 7C is a graph which shows an example of the shape of a signal of the absolute value of the sound signal. The graph 720 which is shown in FIG. 7C shows the envelope 721 of the signal of the absolute value of the sound signal of the graph 710. The abscissa of the graph 720 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S304). The sound jam detector 153 determines whether the value of the envelope 721 is the first threshold value Th1 or more at each predetermined time interval (for example, sampling intervals of sound signal), increments the counter value when the value of the envelope 721 is the first threshold value Th1 or more, and decrements the counter value when it is less than the first threshold value Th1.

Figure 7D:
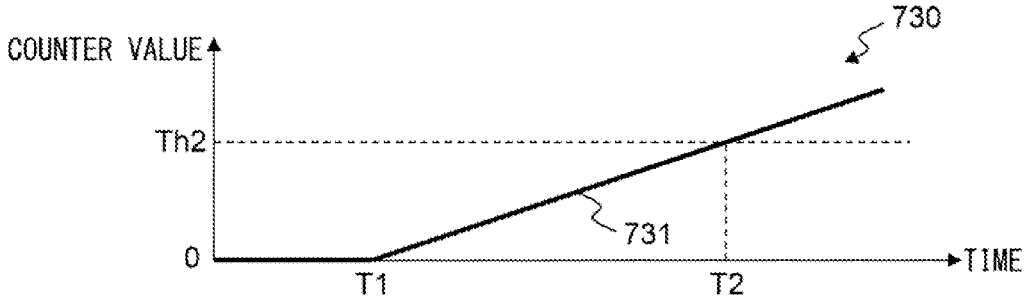
FIG. 7D is a view for explaining processing for detection of an occurrence of a jam.

FIG. 7D is a graph which shows an example of the counter value which is calculated for the shape of the signal of the absolute value of the sound signal. The graph 730 which is shown in FIG. 7D expresses the counter value which is calculated for the envelope 721 of the graph 720. The abscissa of the graph 720 shows the time, while the ordinate shows the counter value.

Next, the sound jam detector 153 determines whether the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 7C, the envelope 721 is the first threshold value Th1 or more at the time T1 and thereafter does not become less than the first threshold value Th1. For this reason, as shown in FIG. 7D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

Figure 8A:
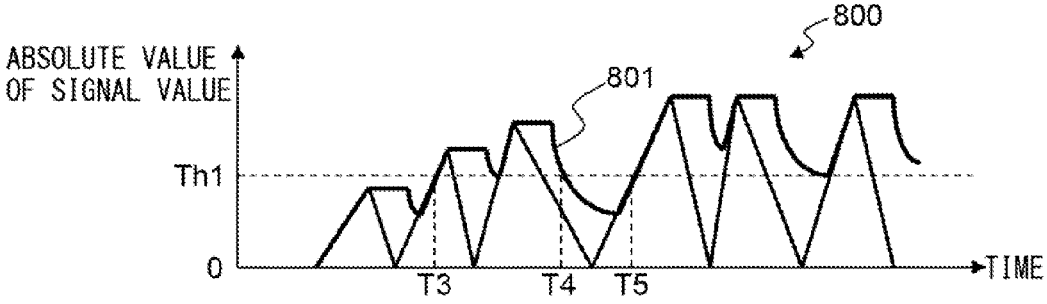
FIG. 8A is a view for explaining processing for detection of an occurrence of a jam.
Figure 8B:
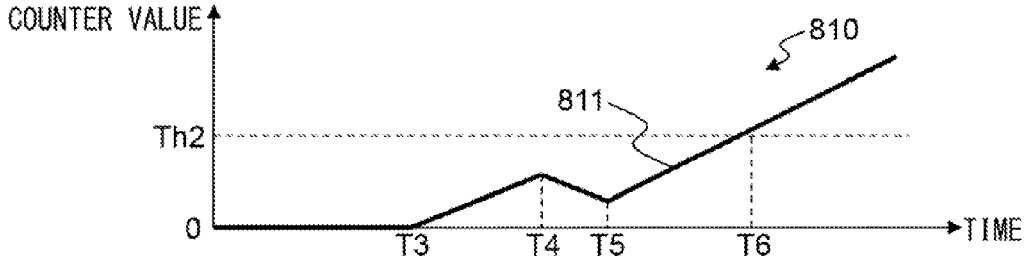
FIG. 8B is a view for explaining processing for detection of an occurrence of a jam.

FIG. 8A and FIG. 8B are views for explaining the processing for acquiring the peak hold signal from the sound signal and determining whether a sound jam has occurred.

The graph 800 which is shown in FIG. 8A expresses the peak hold signal 801 for the signal of the absolute value of the sound signal of the graph 710. The abscissa of the graph 800 shows the time, while the ordinate shows the absolute value of the signal value of the sound signal.

The graph 810 which is shown in FIG. 8B shows the counter value which was calculated for the peak hold signal 801 of the graph 800. The abscissa of the graph 810 shows the time, while the ordinate shows the counter value. The peak hold signal 801 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 8B, the counter value increases from the time T3, decreases from the time T4, again increases from the time T5, and becomes the second threshold value Th2 or more at the time T6, so it is determined that a sound jam has occurred.

Figure 9:
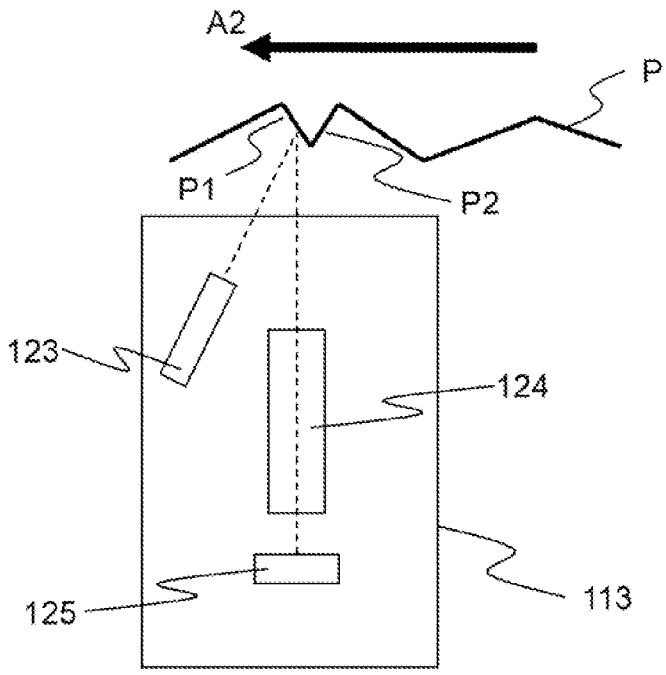
FIG. 9 is a view for explaining an example of a wrinkle detector 113.

FIG. 9 is a view for explaining an example of a wrinkle detector 113.

The wrinkle detector 113 has a light source 123, lens 124, optical sensor 125, etc., and optically detects a wrinkle of the paper.

The light source 123 includes RGB color LEDs (light emitting diodes) and a light guiding member and emits light to the surface of the paper which is conveyed to the wrinkle detector 113. Note that, the light source 123 emits light from a slanted direction with respect to the paper conveyance direction A2.

The lens 124 makes the light which is reflected at the paper enter the optical sensor 125. The lens 124 is, for example, comprised of a rod lens array. By passage of the light of the light source 123 which was reflected at the surface of the paper, an erect image of the surface of a paper is displayed by equal magnification on a not shown line sensor of the optical sensor 125.

The optical sensor 125 is a CIS of an equal magnification optical type which is provided with an image capture element using CMOS's arranged in a line in the main scan direction. It generates and outputs an analog image signal in accordance with the light which passes through the lens 124. The analog image signal which is output from the optical sensor 125 is converted from an analog to digital format by the third image A/D conversion unit 140*c* to acquire a digital image data which is then output to the central processing unit 150. Below, this digital image data will be referred to as a "wrinkle detection-use image".

Note that, the wrinkle detector 113 may have an optical sensor using CCDs instead of a CIS. However, an equal magnification optical sensor such as a CIS, compared with a reduced magnification optical sensor using CCDs, has a shallower depth of object field. Differences in brightness due to surface relief of the surface of the paper easily occur at the image acquired by reading a paper. For this reason, for the wrinkle detector 113, preferably an equal magnification optical sensor is utilized. Note that, the wrinkle determination module 156 may also be used for the sound jam detector 153.

Figure 10:
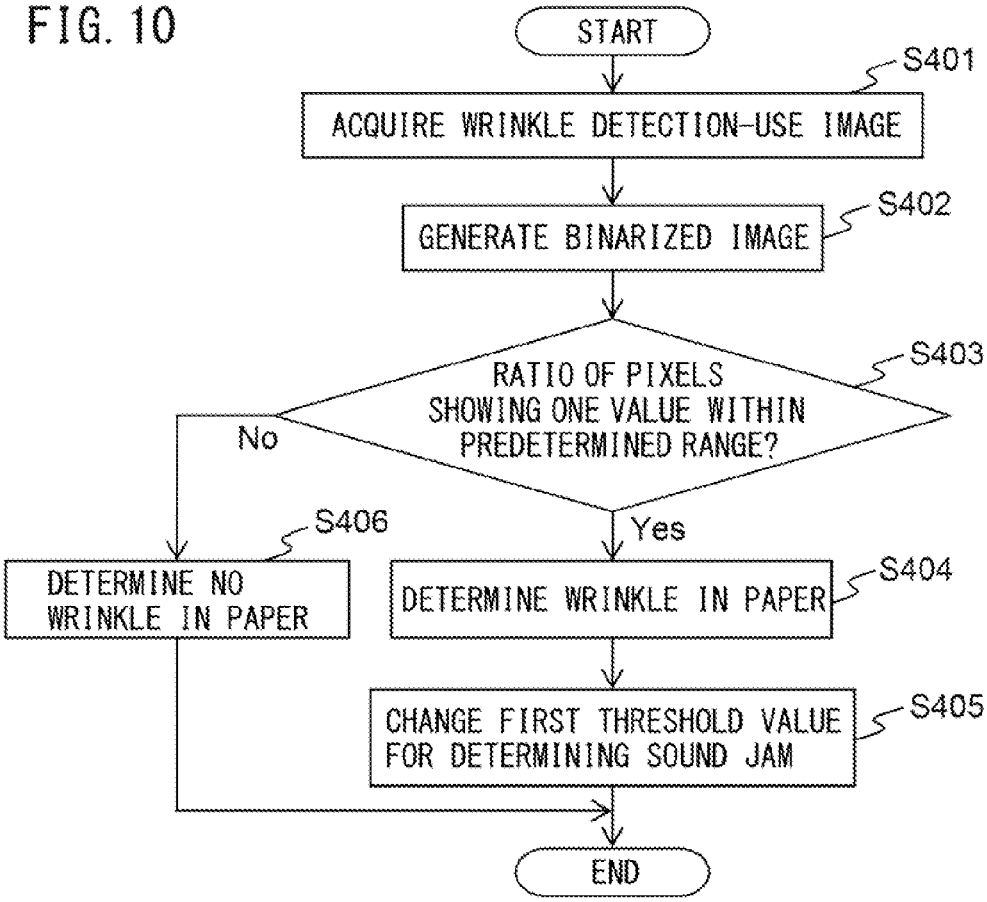
FIG. 10 is a flow chart which shows an example of operation of wrinkle detection processing.

FIG. 10 is a flow chart which shows an example of operation of wrinkle determination processing.

The flow of operation which is explained below is performed based on a program which is stored in advance in the storage unit 147 by mainly a central processing unit 150 in cooperation with the elements of the paper conveying apparatus 100.

First, the wrinkle determination module 156 makes the wrinkle detector 113 read the conveyed paper and acquires a wrinkle detection-use image through the third image A/D conversion unit 140*c* (step S401).

Next, the wrinkle determination module 156 binarizes the wrinkle detection-use image by a predetermined binarization threshold value and generates a binarized image (step S402).

Next, the wrinkle determination module 156 determines whether the ratio of pixels which show one value in all pixels in the binarized image of the wrinkle detection-use image is within a predetermined range (for example, 40% to 60%) (step S403).

The wrinkle determination module 156 determines that a paper has a wrinkle when the ratio of pixels which show one value in all pixels in the binarized image of the wrinkle detection-use image is within a predetermined range (step S404).

Figure 11:
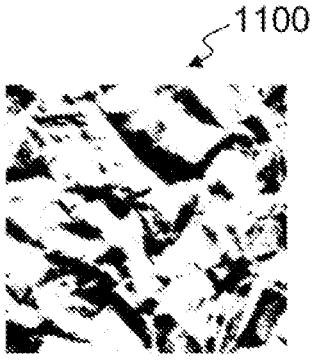
FIG. 11 is a view which shows an example of a binarized image of a wrinkle detection-use image of a paper which has a wrinkle.

FIG. 11 shows an example of a binarized image 1100 of the wrinkle detection-use image for a paper which has a wrinkle.

The binarized image 1100 which is shown in FIG. 11 is an image acquired by binarizing the wrinkle detection-use image for a paper P which has a wrinkle which is shown in FIG. 9. As shown in FIG. 9, when a paper P which has a wrinkle is conveyed to the wrinkle detector 113, the amount of light which is received by the optical sensor 125 differs between a surface P1 which is directly struck by light from the light source 123 and a surface P2 which light from the light source 123 does not easily strike. For this reason, in a wrinkle detection-use image which is generated from a paper P which has a wrinkle, differences in brightness occur due to the wrinkle. At that binarized image 1100, there is a tendency for just pixels expressing one of the values to not become much greater. On the other hand, in most papers on which text, graphics, etc. are printed, the region which expresses the background accounts for the majority of the area, so if the paper does not have a wrinkle, in the binarized image, there is a tendency for just pixels expressing one value to become much greater.

If the wrinkle determination module 156 determines that a paper has a wrinkle, the method of detection of a sound jam is changed (step S405) and the series of steps is ended. For example, the wrinkle determination module 156 increases the first threshold value Th1 for comparison with the envelope or the peak hold signal for the sound jam detector 153 to determine to increment or decrement the counter value. Note that, the wrinkle determination module 156 may also increase the second threshold value Th2 for comparison with the counter value for the sound jam detector 153 to determine whether a jam has occurred. Further, when the sound jam detector 153 acquires the peak hold signal and determines a jam, the wrinkle determination module 156 may shorten the hold period where the local maximum value is held or may increase the attenuation rate. Due to this, even when conveyance of a paper which has a wrinkle causes a large sound to be generated in the conveyance path, the sound jam detector 153 does not easily determine the occurrence of a jam in the sound jam detection processing and can be kept from erroneously determining the occurrence of a jam.

On the other hand, at step S403, if the ratio of pixels which show one value is not in a predetermined range, the wrinkle determination module 156 determines the paper has no wrinkles (step S406). In this case, the wrinkle determination module 156 ends the series of steps without particularly performing any processing. Note that, the flow chart which is shown in FIG. 10 is executed at the timing when the central processing unit 150 drives the drive unit 145 to rotate the paper feed roller 111 and the retard roller 112 and the front end of the paper reaches the wrinkle detector 113.

Note that, at step S403, the wrinkle determination module 156 may generate a histogram of the luminance values of the pixels of the wrinkle detection-use image, determines that there is a wrinkle at the paper when the number of luminance values with a distribution value (population) of a predetermined value or more is a predetermined number or more, and determines that there is no wrinkle at the paper when it is less than the predetermined number. If the paper has a wrinkle, the wrinkle detection-use image will have bright and dark parts due to the wrinkle and will have pixels with various luminance values, so it is possible to determine there is a wrinkle in a paper precisely by this as well.

As shown in FIG. 2, the wrinkle detector 113 is arranged at the downstream side of the paper feed roller 111 and the retard roller 112, that is, inside the paper conveying apparatus 100, so it is possible to generate an image free of the effects of the lighting, natural light, etc., illuminating the location at which the paper conveying apparatus 100 is installed. Further, the wrinkle detector 113 can detect a wrinkle even when the initial paper has no wrinkle, but the paper feed roller 111 and the retard roller 112 cause a wrinkle in the paper.

Further, the microphone 114 is provided near the paper feed roller 111 and the retard roller 112 which separate the papers so as to detect the sound which is generated at the paper feed roller 111 and retard roller 112. On the other hand, as explained above, the wrinkle determination module 156 determines whether a conveyed paper has a wrinkle based on the image which the wrinkle detector 113 generates, and changes the method of detection of a sound jam, using the result of determination. For this reason, the wrinkle detector 113 is preferably provided near the paper feed roller 111 and the retard roller 112 so that it can output the image signal for the conveyed paper at as early a timing as possible. In particular, the wrinkle detector 113 preferably outputs an image signal for a conveyed paper before the microphone 114 outputs a sound signal for the conveyed paper, and preferably is provided at the upstream side of the microphone 114.

Figure 12:
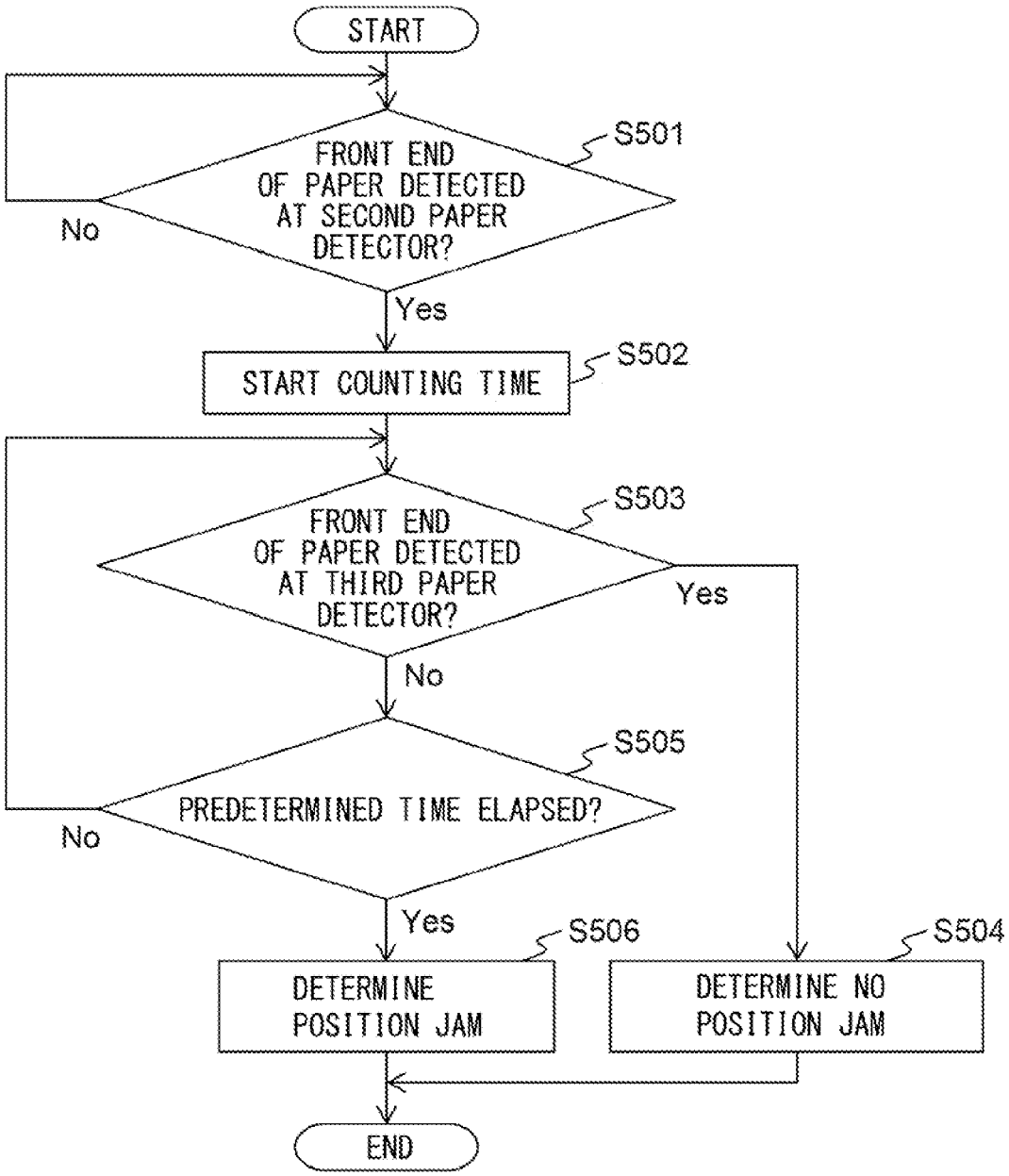
FIG. 12 is a flow chart which shows an example of operation of a position jam detection processing.

FIG. 12 is a flow chart which shows an example of operation of a position jam detection processing.

The flow of operation which is shown in FIG. 12 is executed at step S202 of the flow chart which is shown in FIG. 5.

First, the position jam detector 154 stands by until the front end of the paper is detected by the second paper detector 115 (step S501). The position jam detector 154 determines that the front end of the paper is detected at the position of the second paper detector 115, that is, downstream of the paper feed roller 111 and retard roller 112 and upstream of the first conveyor roller 117 and first driven roller 118, when the value of the second paper detection signal from the second paper detector 115 changes from a value which shows the state where there is no paper to a value which shows the state where there is one.

Next, when the second paper detector 115 detects the front end of a paper, the position jam detector 154 starts counting time (step S502).

Next, the position jam detector 154 determines whether the third paper detector 119 has detected the front end of the paper (step S503). The position jam detector 154 determines that the front end of the paper is detected at the position of the third paper detector 119, that is, downstream of the first conveyor roller 117 and first driven roller 118 and upstream of the image capture unit 120, when the value of the third paper detection signal from the third paper detector 119 changes from a value which shows the state where there is no paper to a value which shows the state where there is one.

When the third paper detector 119 detects the front end of a paper, the position jam detector 154 determines that no position jam has occurred (step S504) and ends the series of steps.

On the other hand, if the third paper detector 119 detects the front end of the paper, the position jam detector 154 determines whether a predetermined time (for example, 1 second) has elapsed from the start of counting time (step S505). If a predetermined time has not elapsed, the position jam detector 154 returns to the processing of step S503 and again determines whether the third paper detector 119 has detected the front end of the paper. On the other hand, when a predetermined time has elapsed, the position jam detector 154 determines that position jam has occurred (step S506) and ends the series of steps. Note that, when position jam detection processing is not required in the paper conveying apparatus 100, this may be omitted.

Note that, when the central processing unit 150 detects that the front end of a paper is downstream of the first conveyor roller 117 and the first driven roller 118 by the third paper detection signal from the third paper detector 119, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 115, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 119 does not detect the front end of a paper within a predetermined time.

Figure 13:
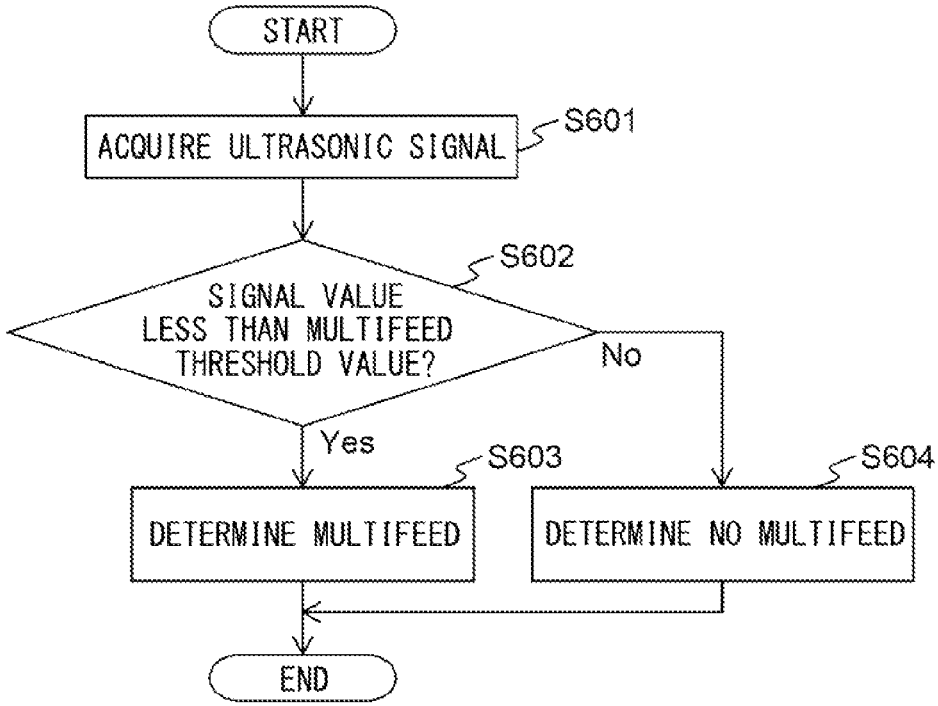
FIG. 13 is a flow chart which shows an example of operation of multifeed detection processing.

FIG. 13 is a flow chart which shows an example of operation of multifeed detection processing.

The flow of operation which is shown in FIG. 13 is executed at step S203 of the flow chart which is shown in FIG. 5.

First, the multifeed detector 155 acquires an ultrasonic signal from the ultrasonic sensor 116 (step S601).

Next, the multifeed detector 155 determines whether the signal value of the acquired ultrasonic signal is less than the multifeed detection threshold value (step S602).

Figure 14:
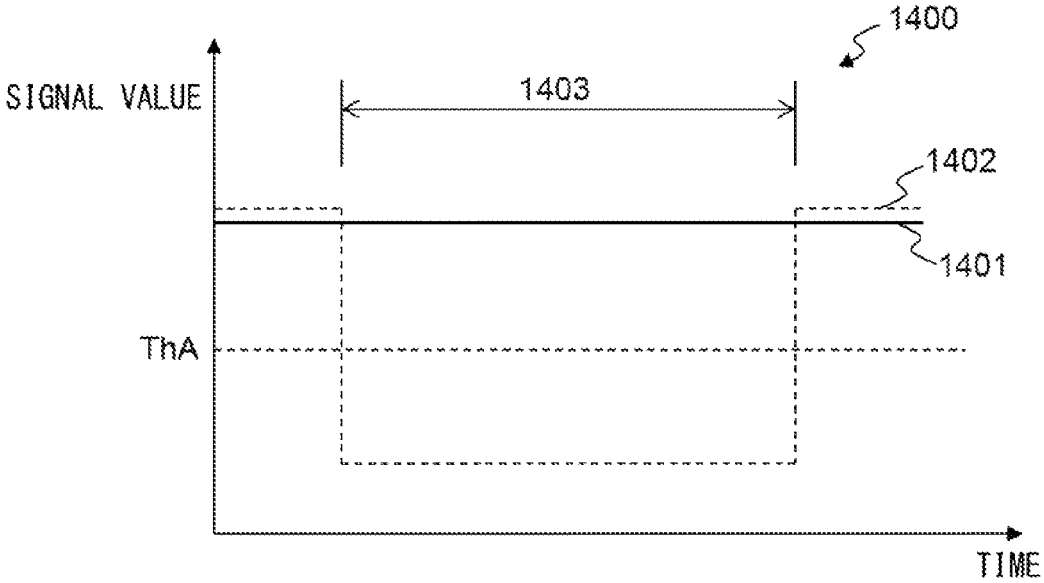
FIG. 14 is a view for explaining properties of an ultrasonic signal.

FIG. 14 is a view for explaining properties of an ultrasonic signal.

In the graph 1400 of FIG. 14, the solid line 1401 shows the characteristic of the ultrasonic signal in the case where a single paper is conveyed, while the broken line 1402 shows the characteristic of the ultrasonic signal in the case where multifeed of papers has occurred. The abscissa of the graph 1400 shows the time, while the ordinate shows the signal value of the ultrasonic signal. Due to the occurrence of multifeed, the signal value of the ultrasonic signal of the broken line 1402 falls in the section 1403. For this reason, it is possible to determine whether multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S603), determines that multifeed of the papers has not occurred when the signal value of the ultrasonic signal is the multifeed detection threshold value or more (step S604), and ends the series of steps. Note that, when multifeed detection processing is not necessary in the paper conveying apparatus, this may be omitted.

As explained above in detail, the paper conveying apparatus 100 is provided with a wrinkle detector 113 at the downstream side of the paper feed roller 111 and the retard roller 112 and operates in accordance with the flow chart which is shown in FIG. 4, FIG. 5, FIG. 6, and FIG. 10 so as to be able to detect wrinkles which occur at the paper feed roller 111 and retard roller 112. Accordingly, even when wrinkles are caused after conveyance, it becomes possible to suppress erroneous detection of the occurrence of a jam by sound due to the sound which is generated by a paper which has a wrinkle.

Further, the wrinkle detector 113 is provided at the downstream side of the paper feed roller 111 and the retard roller 112 and is arranged at the inside of the paper conveying apparatus 100. Therefore, the wrinkle detection by the wrinkle detector 113 is not affected by the lighting, natural light, etc., so it is possible to precisely determine whether a conveyed paper has a wrinkle.

Figure 15:
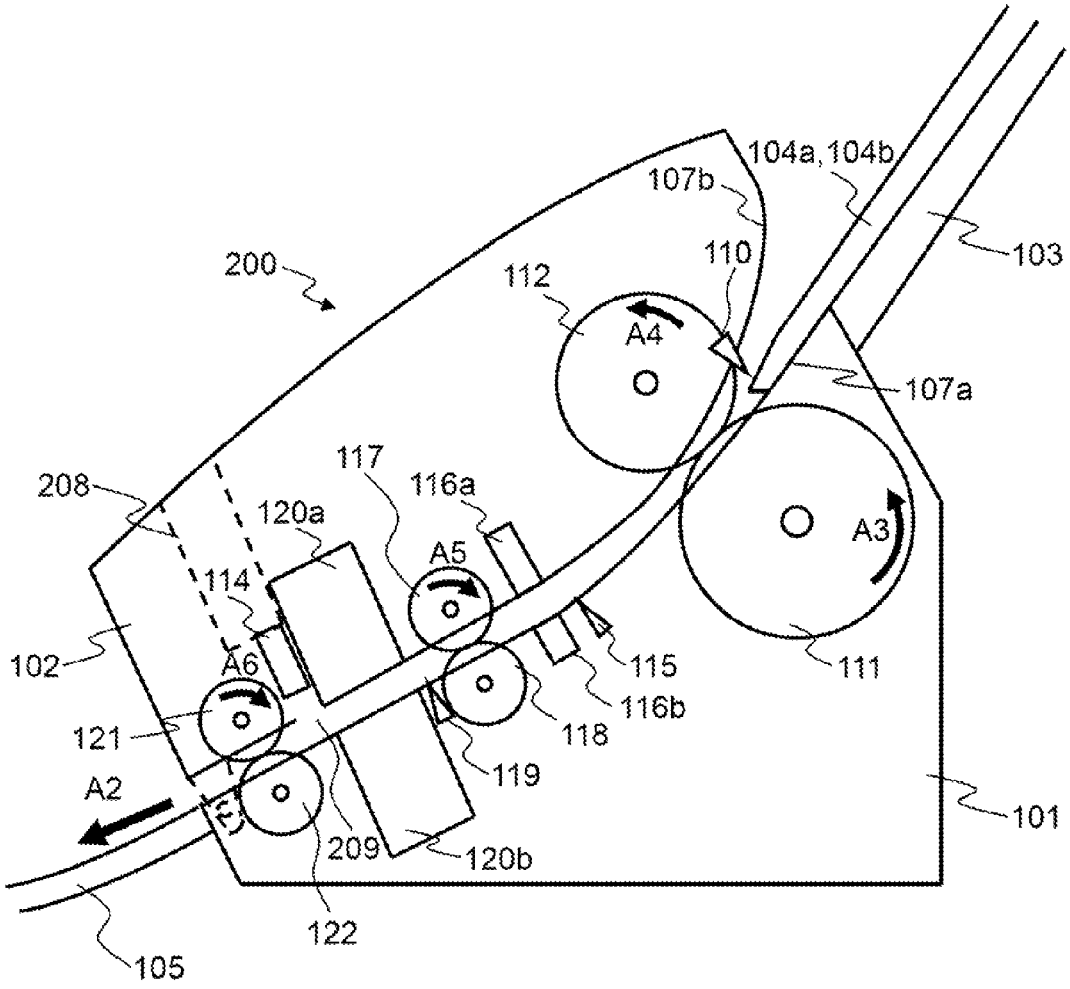
FIG. 15 is a view for explaining an example of a conveyance route at the inside of a paper conveying apparatus 200 according to another embodiment.

FIG. 15 is a view for explaining an example of a conveyance route at the inside of a paper conveying apparatus 200 according to still another embodiment.

The paper conveying apparatus 200 which is shown in FIG. 15 utilizes the first image capture unit 120*a* and the second image capture unit 120*b*, instead of the wrinkle detector 113 of the paper conveying apparatus 100 which is shown in FIG. 2, and shifts the position of the microphone 114 to downstream of the first image capture unit 120*a* and the second image capture unit 120*b*. This paper conveying apparatus 200 utilizes the read image based on the image signal which is output from the image capture unit 120 as the wrinkle detection-use image. That is, in this paper conveying apparatus 200, the image capture unit 120 reads an image from a paper and functions as a wrinkle detector to optically detect a wrinkle of the paper.

As explained above, the wrinkle detector is preferably provided at the upstream side of the microphone, so the microphone 114 is arranged at the downstream side of the image capture unit 120 while being fastened to a frame 208 of the inside of the upper housing 102. Further, a position of the upper guide 107*b* facing the microphone 114 is provided with a hole 209 for the microphone 114 to detect sound.

Figure 16:
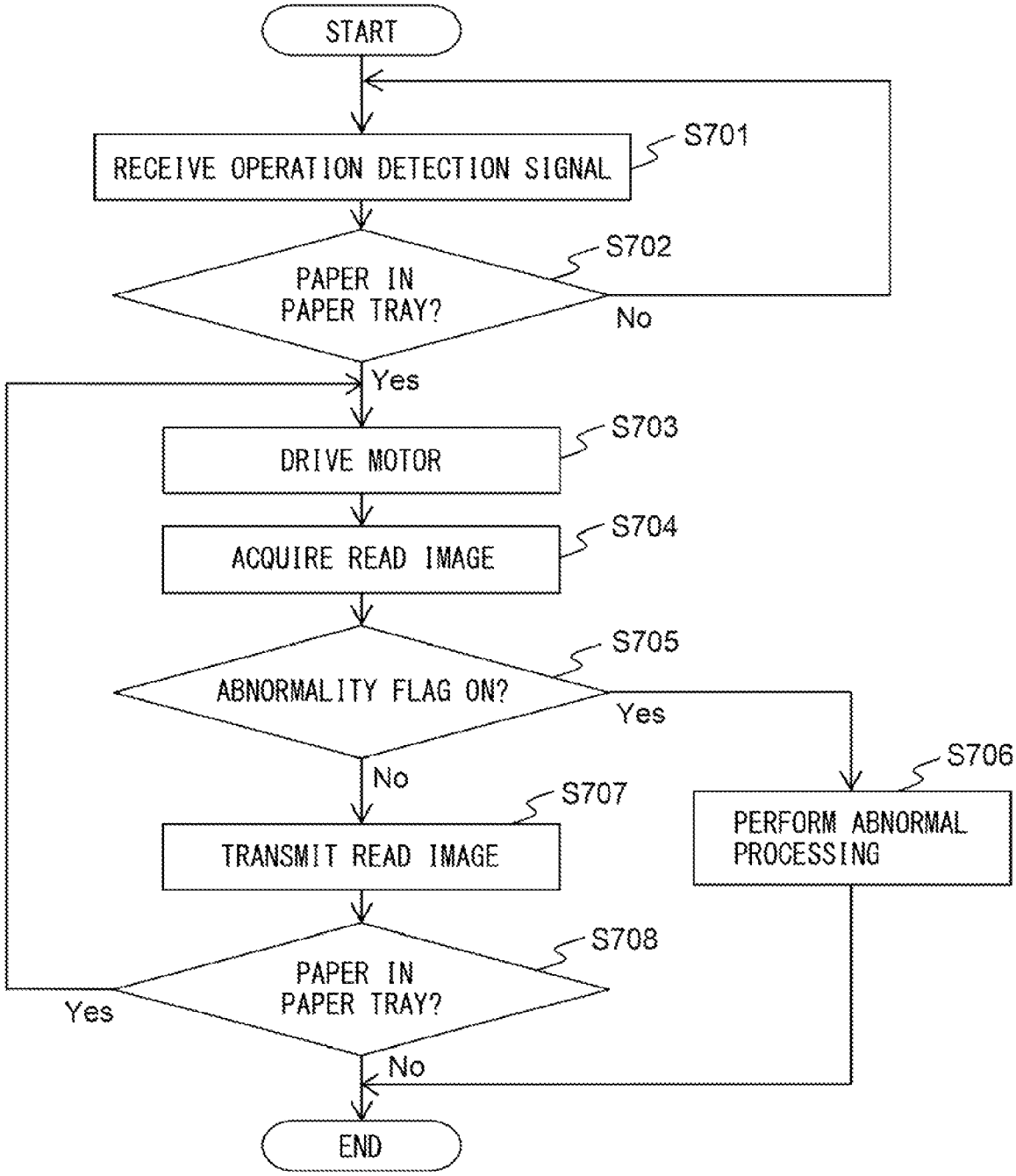
FIG. 16 is a flow chart which shows an example of operation of overall processing of a paper conveying apparatus 200.

FIG. 16 is a flow chart which shows an example of operation of overall processing of the paper conveying apparatus 200.

Below, while referring to the flow chart which is shown in FIG. 16, an example of operation of the overall processing of the paper conveying apparatus 200 will be explained. Note that, the flow of operation which is explained below is performed based on a program which is stored in the storage unit 147 in advance by mainly the central processing unit 150 in cooperation with the elements of the paper conveying apparatus 200.

In the flow chart which is shown in FIG. 16, different from the flow chart which is shown in FIG. 4, the paper conveying apparatus 200 utilizes the read image from the image capture unit 120 as a wrinkle detection-use image, so performs paper reading processing before determining whether the abnormality flag is ON. The processing of steps S701 to S703, S705 to S706, and S708 which are shown in FIG. 16 is the same as the processing of steps S101 to S103, S104 to S105, and S108 which are shown in FIG. 4, so explanation will be omitted. Below, only the processing of steps S704 and S707 will be explained.

At step S704, the image generator 152 makes the first image capture unit 120*a* and the second image capture unit 120*b* read the conveyed paper and acquires the read image through the first image A/D conversion unit 140*a* and the second image A/D conversion unit 140*b*. The wrinkle determination module 156 acquires the read image as the wrinkle detection-use image which is used for wrinkle determination processing at step S401 of the flow chart which is shown in FIG. 10.

Further, at step S706, if the control module 151 determines that the abnormality flag is not ON, the central processing unit 150 transmits the read image which is acquired at step S704 through the interface 146 to a not shown data processing apparatus (step S707).

As explained above in detail, even if the paper conveying apparatus utilizes the image capture unit as a wrinkle detector and operates in accordance with the flow chart which is shown in FIG. 16, it becomes possible to precisely determine whether there is a wrinkle in a paper and becomes possible to suppress erroneous detection of the occurrence of a jam. Further, by using the optical sensor for reading a paper as the optical sensor for wrinkle detection, reduction of the hardware costs becomes possible.

Figure 17:
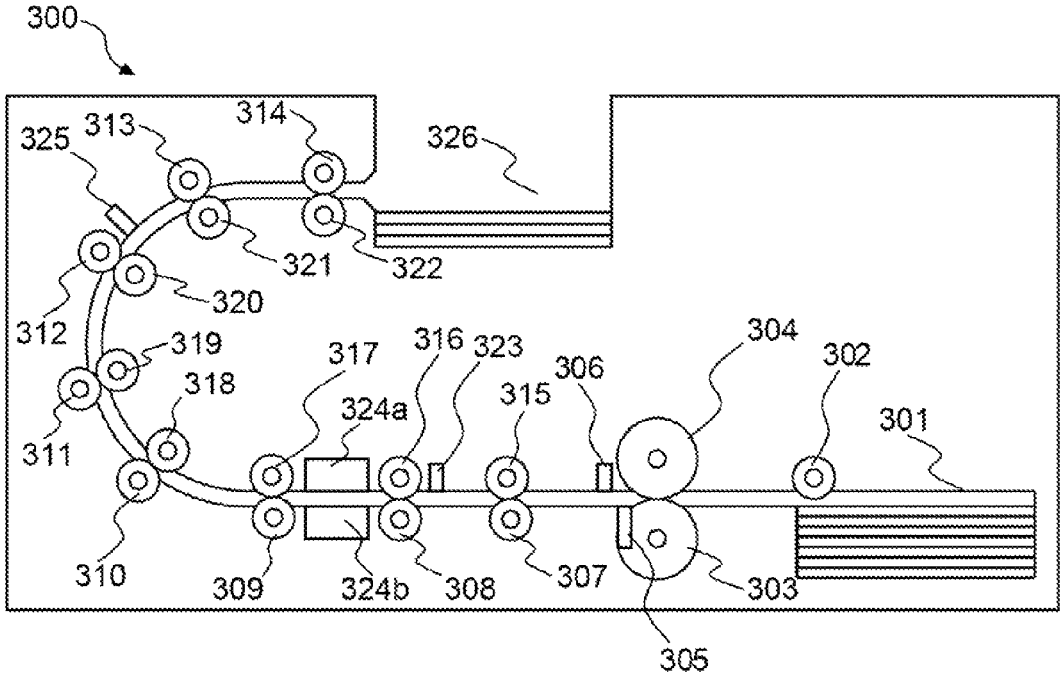
FIG. 17 is a view for explaining an example of a conveyance route at the inside of a paper conveying apparatus 300 according to still another embodiment.

FIG. 17 is a view for explaining an example of a conveyance route at the inside of a paper conveying apparatus 300 according to still another embodiment.

The paper conveying apparatus 300 which is shown in FIG. 17 is a type of paper conveying apparatus with a conveyance path longer than the paper conveying apparatus 100 which is shown in FIG. 2.

The paper conveying apparatus 300 has a paper loader 301, a pick roller 302, a paper feed roller 303, a retard roller 304, a wrinkle detector 305, a first microphone 306, conveyor rollers 307, 308, 309, 310, 311, 312, 313, 314, driven rollers 315, 316, 317, 318, 319, 320, 321, 322, a second microphone 323, a first image capture unit 324*a*, a second image capture unit 324*b*, third microphone 325, a paper ejector 326, etc.

The wrinkle detector 305 is arranged at the downstream side of the paper feed roller 303 and retard roller 304 and the upstream side of the first microphone 306, second microphone 323, and third microphone 325.

The first microphone 306 detects the sound when papers are separated by the paper feed roller 303 and retard roller 304. The second microphone 323 detects the sound right before a paper is read by the first image capture unit 324*a* and the second image capture unit 324*b*. The third microphone 325 detects the conveyance sound of a paper at a part where the conveyance path bends.

In the paper conveying apparatus 300, doubled papers which have been picked up by the pick roller 302 from the paper loader 301 are separated by the paper feed roller 303 and retard roller 304 and loaded sheet by sheet to the conveyance path. A paper which is loaded into the conveyance path is conveyed by the conveyor rollers and driven rollers, is read by first image capture unit 324*a* and second image capture unit 324*b*, and is ejected to the paper ejector 326.

The central processing unit of the paper conveying apparatus 300 determines whether a jam has occurred at the positions at which the microphones are arranged based on sound signals which the first microphone 306, second microphone 323, and third microphone 325 generate. The central processing unit determines whether there is wrinkle at the paper from the wrinkle detection-use image based on the image signal of the wrinkle detector 305 and, when judging there is a wrinkle, changes the parameter for determining a jam based on the sound signals which the first microphone 306, second microphone 323, and third microphone 325 generate.

Note that, the third microphone 325 is positioned at the downstream side of the first image capture unit 324*a* and the second image capture unit 324*b*. For this reason, the central processing unit may change the parameter for determining a jam based on the sound signal which the third microphone 325 generates, by using the result of determination whether there is a wrinkle in a paper, using a read image based on the image signals from the first image capture unit 324*a* and the second image capture unit 324*b*. Due to this, the paper conveying apparatus 300 can detect a wrinkle formed on a paper right before the paper is conveyed to the first image capture unit 324*a* and second image capture unit 324*b*.

As explained above in detail, the paper conveying apparatus can suppress erroneous detection of the occurrence of a jam even when there are a plurality of microphones.

Figure 18:
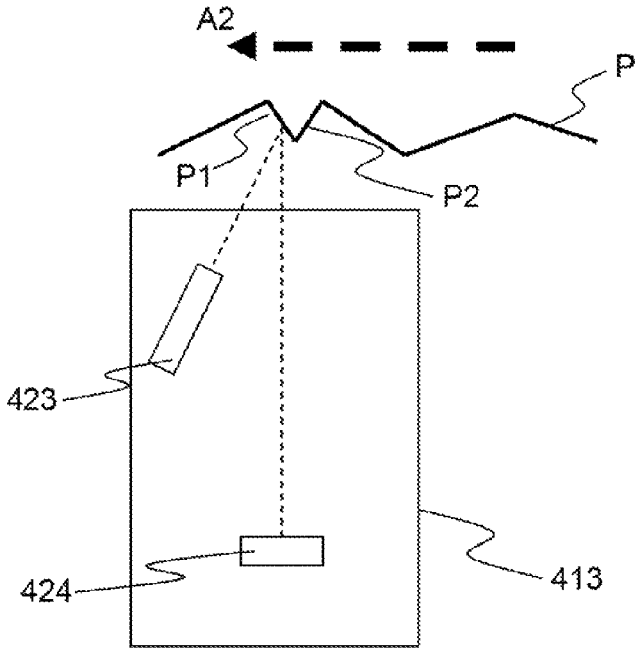
FIG. 18 is a view which shows an example of another schematic configuration of a wrinkle detector.

FIG. 18 is a view which shows an example of another schematic configuration of a wrinkle detector.

The wrinkle detector 413 which is shown in FIG. 18 includes an infrared light emitter 423 and an infrared light detector 424.

The infrared light emitter 423 emits infrared light (near infrared light) on the surface of the paper which is conveyed to the wrinkle detector 413. Note that, the infrared light emitter 423 emits light from a slanted direction with respect to the paper conveyance direction A2.

The infrared light detector 424 optically detects infrared light which is reflected from the paper and generates and outputs an analog image signal corresponding to the infrared light which was received. In this case, this analog image signal is converted from an analog to digital format and the digital image data is utilized as a wrinkle detection-use image.

Infrared light, which has a wavelength longer than visible light, has the property of being resistant to the effects of the paper quality (fiber structure of cellulose). Further, most dyes and materials absorb a specific wavelength of visible light, but do not absorb infrared light. For this reason, the paper conveying apparatus can use infrared light to reduce the effects of the paper quality of the paper and the information which is printed on the paper and thereby precisely determine for the presence of a wrinkle.

As explained above in detail, the paper conveying apparatus can use infrared light to more precisely detect the occurrence of a jam.

According to the paper conveying apparatus and the jam detection method, and the computer-readable, non-transitory medium, the wrinkle detector is provided at the downstream side of the separator in the paper conveyance direction and can detect a wrinkle which has occurred at the separator, so it is possible to suppress erroneous detection of the occurrence of a jam by sound due to the sound which a paper which has a wrinkle generates.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a separator;

an image reader for reading an image from a paper separated by the separator;

a sound signal generator including a sound detector provided at a downstream side of the separator in a paper conveyance direction, for generating a sound signal corresponding to a sound generated by a paper during conveyance of the paper;

a sound jam detector for determining whether a jam has occurred based on the sound signal, using a detection method; and a wrinkle detector, provided at a downstream side of the separator in the paper conveyance direction, for optically detecting a wrinkle of the paper, wherein the sound jam detector changes the detection method when the wrinkle detector detects the wrinkle of the paper, and the image reader is utilized as the wrinkle detector.

2. The paper conveying apparatus according to claim 1, wherein the wrinkle detector is provided at an upstream side of the sound detector in the paper conveyance direction.

3. The paper conveying apparatus according to claim 1, wherein the wrinkle detector has an optical sensor, and the optical sensor optically detects a wrinkle of a paper and reads an image from the paper.

4. The paper conveying apparatus according to claim 1, wherein the wrinkle detector includes an equal magnification optical sensor.

5. The paper conveying apparatus according to claim 1, wherein the wrinkle detector has an infrared light emitter for emitting infrared light to a paper and an infrared light detector for optically detecting infrared light reflected from the paper.

6. A jam detection method comprising:

acquiring a sound signal from a sound signal generator including a sound detector provided at a downstream side of a separator in a paper conveyance direction, for generating the sound signal corresponding to a sound generated by a paper during conveyance of the paper;

determining whether a jam has occurred based on the sound signal and using a detection method;

detecting, by a computer, an output of a wrinkle detector, provided at a downstream side of the separator in the paper conveyance direction, for optically detecting optically a wrinkle of a paper;

acquiring an image from an image reader for reading an image from a paper separated by the separator; and changing by the computer the detection method of detection of the jam when the wrinkle of a paper is detected, wherein the image reader is utilized as the wrinkle detector.

7. A computer-readable, non-transitory medium storing a computer program, wherein the computer program causes a computer to execute a process, the process comprising:

acquiring a sound signal from a sound signal generator including a sound detector provided at a downstream side of a separator in a paper conveyance direction, for generating the sound signal corresponding to a sound generated by a paper during conveyance of the paper;

determining whether a jam has occurred based on the sound signal and using a detection method;

detecting an output of a wrinkle detector, provided at a downstream side of the separator in the paper conveyance direction, for optically detecting a wrinkle of a paper;

acquiring an image from an image reader for reading an image from a paper separated by the separator; and changing by the computer the detection method when the wrinkle of a paper is detected, wherein the image reader is utilized as the wrinkle detector.

* * * * *